United States Patent [19]

Kirk

[11] 4,373,475

[45] Feb. 15, 1983

[54] INTERNAL COMBUSTION ENGINE

[75] Inventor: J. David Kirk, Waukegan, Ill.

[73] Assignee: Outboard Marine Corporation, Waukegan, Ill.

[21] Appl. No.: 217,858

[22] Filed: Dec. 18, 1980

[51] Int. Cl.[3] ..... F02B 75/20; F02B 33/04

[52] U.S. Cl. ..... 123/59 B; 123/73 R; 123/73 A; 123/73 PP; 123/74 B; 123/65 EM

[58] Field of Search ..... 123/59 B, 73 R, 73 A, 123/74 B, 65 EM

[56] References Cited

U.S. PATENT DOCUMENTS

| | | | |
|---|---|---|---|
| 1,011,275 | 12/1911 | Thurston | 123/73 R |
| 1,887,661 | 11/1932 | Pielstick | 123/59 B |
| 2,516,031 | 7/1950 | Talvio | 123/73 A |
| 2,740,390 | 4/1956 | Irgens | 123/73 A |
| 3,204,619 | 9/1965 | Rubinowitz et al. | 123/74 R |
| 3,230,944 | 1/1966 | Kiekhaefer | 123/56 BC |
| 3,543,509 | 12/1970 | Boerma | 123/59 B X |
| 3,730,149 | 5/1973 | Brown | 123/73 R |
| 3,815,558 | 6/1974 | Tenney | 123/73 A |
| 3,971,297 | 7/1976 | Fox | 123/73 A |
| 4,306,522 | 12/1981 | Fotsch | 123/73 R |

*Primary Examiner*—Wendell E. Burns
*Attorney, Agent, or Firm*—Michael, Best & Friedrich

[57] ABSTRACT

The invention provides an internal combustion engine comprising a cylinder block having therein a bore and first, second and third openings each communicating with the bore. A cover member having therein first and second cavities is removably attachable on the cylinder block with the first cavity communicating with the first bore opening and the second cavity communicating with each of the second and third bore openings. The cover member cavities and the associated bore openings together form passages communicating with the bore.

10 Claims, 9 Drawing Figures

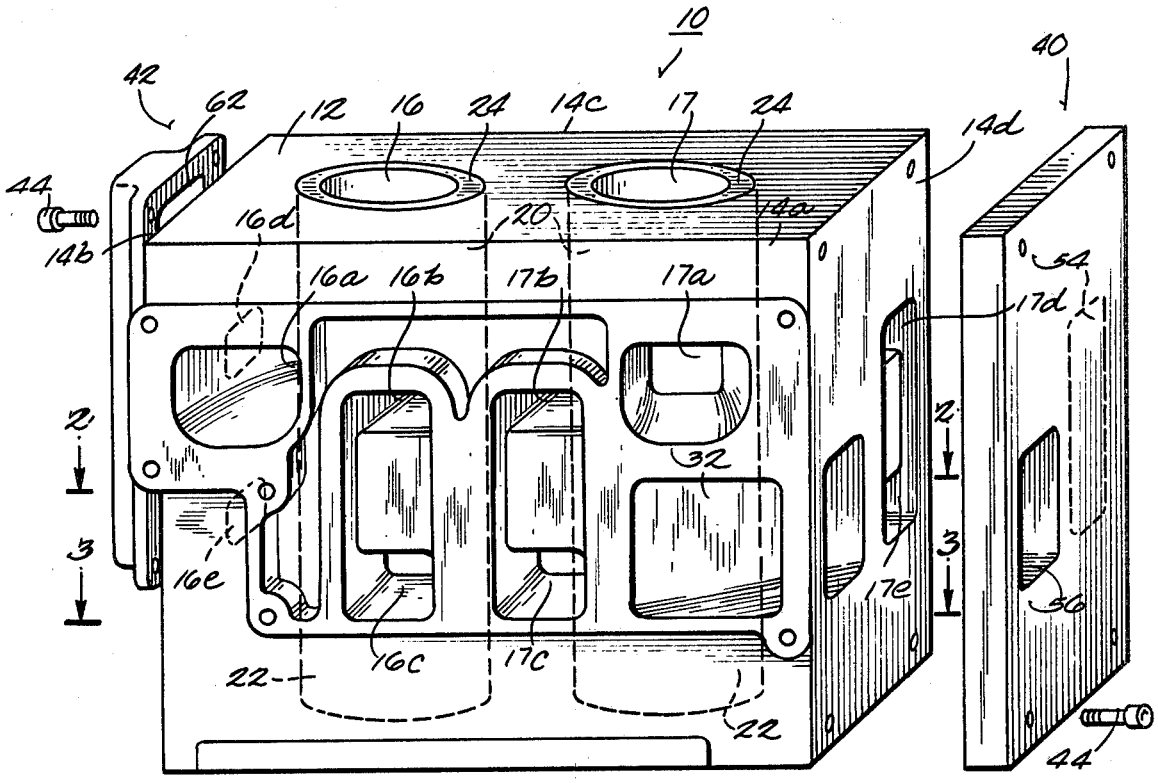
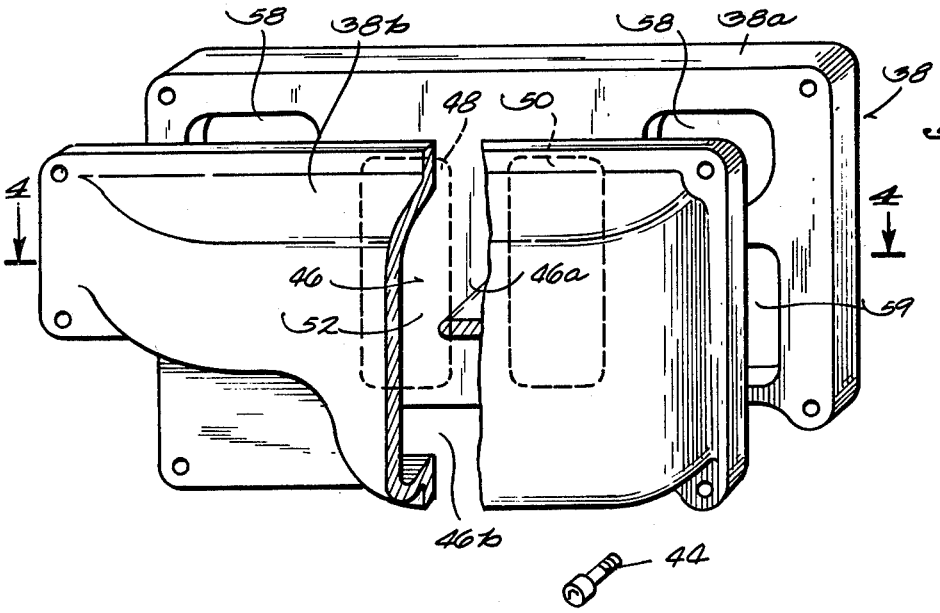
Fig. 1

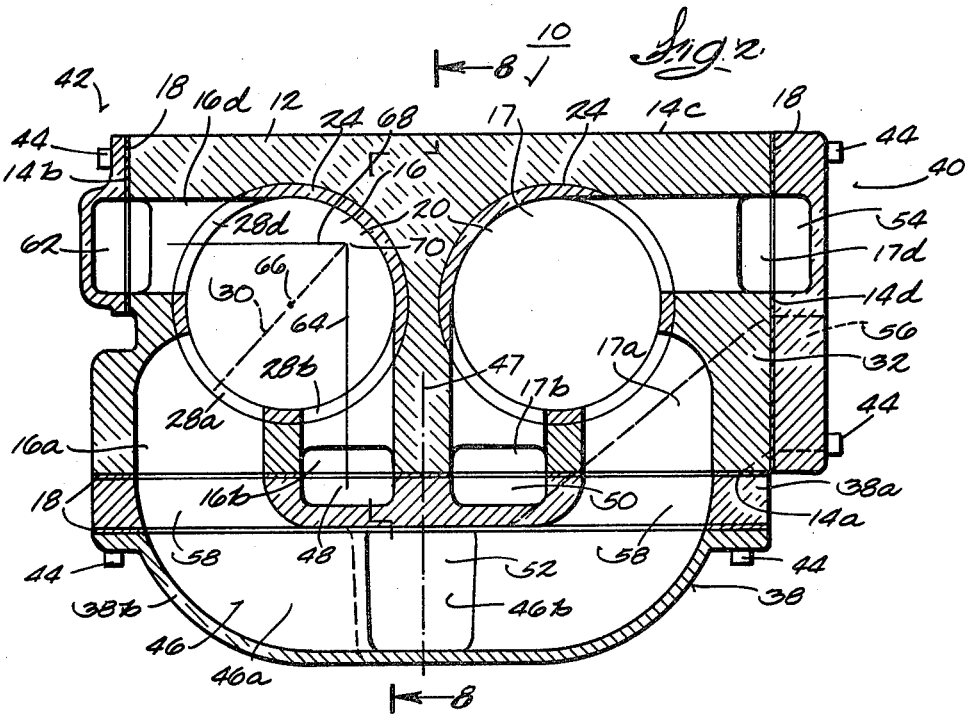
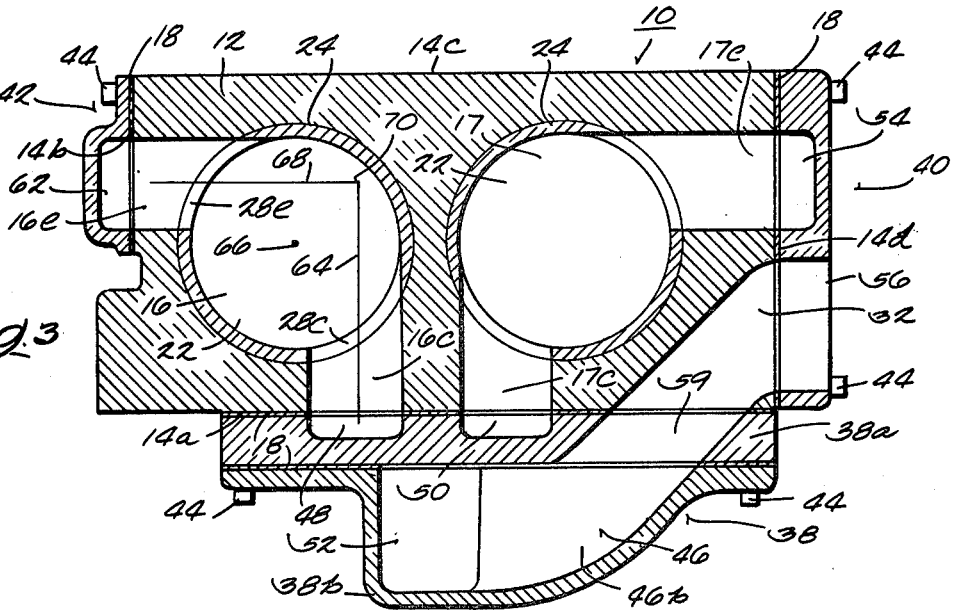
Fig. 3
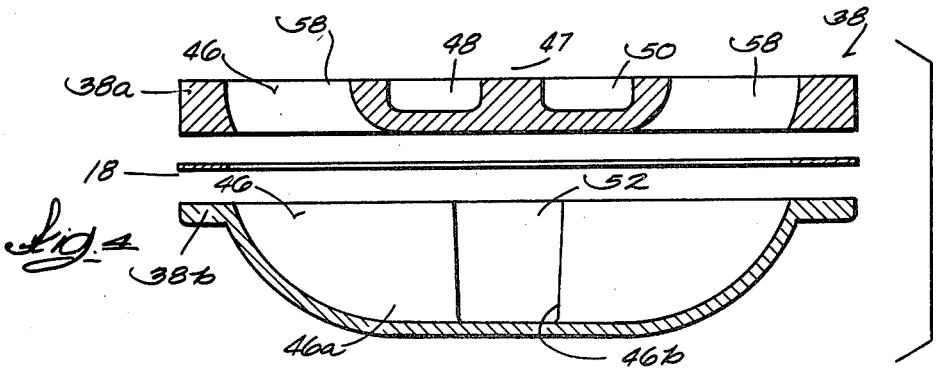
Fig. 4

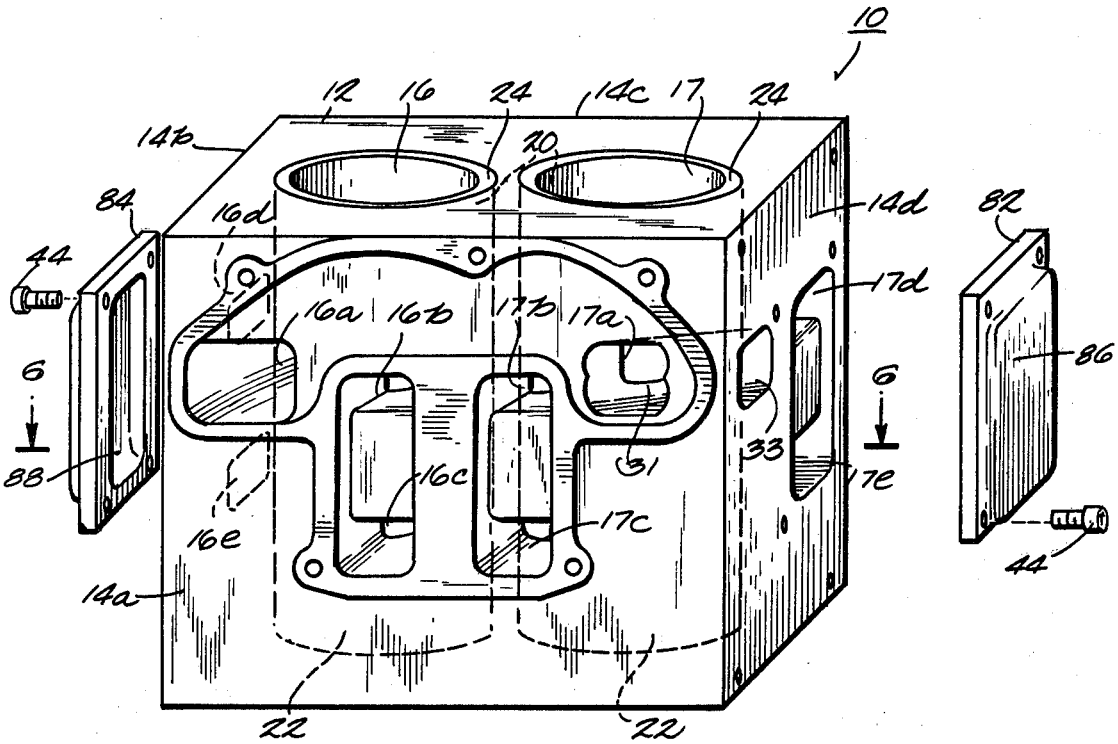
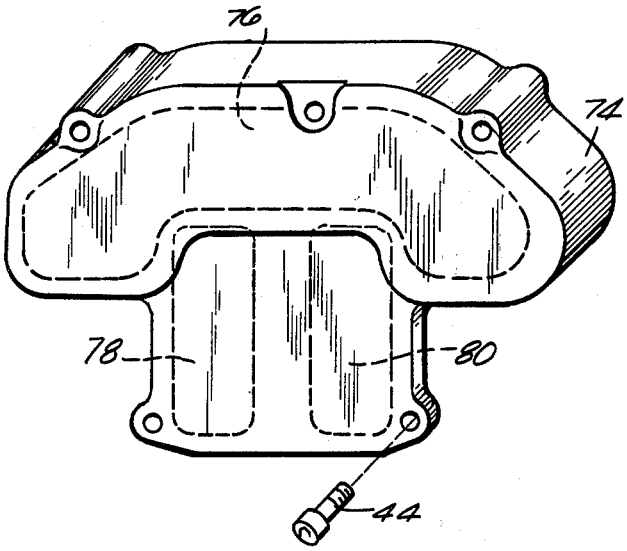
Fig. 5

INTERNAL COMBUSTION ENGINE

BACKGROUND OF THE INVENTION

The invention generally relates to internal combustion engines and, more particularly, to single or multi-cylinder two stroke cycle internal combustion engines.

DESCRIPTION OF THE PRIOR ART

Attention is directed to the following United States Patents in which various internal engine constructions are disclosed:

Thurston, U.S. Pat. No. 1,011,275; Dec. 12, 1911;

Rubinowitz et al, U.S. Pat. No. 3,204,619; Sept. 7, 1965;

Kiekhaefer, U.S. Pat. No. 3,230,944; Jan. 25, 1966;

Boerma, U.S. Pat. No. 3,543,509; Dec. 1, 1970;

Brown, U.S. Pat. No. 3,730,149; May 1, 1973;

Tenney, U.S. Pat. No. 3,815,558; June 11, 1974;

Fox, U.S. Pat. No. 3,971,297; July 27, 1976.

SUMMARY OF THE INVENTION

The invention provides an internal combustion engine comprising a cylinder block having therein a bore and first, second and third openings each communicating with the bore. A cover member having therein first and second cavities is removably attachable on the cylinder block with the first cavity communicating with the first bore opening and the second cavity communicating with each of the second and third bore openings. The cover member cavities and the associated bore openings together form passages communicating with the bore.

In one embodiment, the second and third bore openings are arranged in an axially spaced relationship along the bore, and additional means is provided defining an outlet port communicating with the first cavity and with the atmosphere. In this arrangement, when the cover member is removably attached on the cylinder block, the first cavity and the first bore opening together form an exhaust passage communicating with the bore, and the second cavity and the second and third bore openings together form a transfer passage associated with the bore.

In one embodiment, the cylinder block includes a second bore. A first opening and axially aligned second and third openings each communicates with the second bore. In this embodiment, when the cover member is attached on the cylinder block, the first cavity communicates with the first opening of each of the first and second bores, thereby forming a common exhaust passage. Furthermore, in this embodiment, the cover member includes a third cavity which, when the cover member is attached on a cylinder block, communicates with the second and third openings of the second bore. Thus, the single cover member provides a common exhaust passage and individual transfer passages for the bores.

In one embodiment, axially spaced fourth and fifth openings are provided for each bore. The fourth and fifth openings are arcuately spaced at generally a 90° angle from the second and third openings associated with the same bore. In this embodiment, an additional removably attachable cover member is provided for each bore. This additional cover member includes a cavity which communicates with the fourth and fifth openings of the respective bore, thereby together forming an additional transfer passage communicating with each bore.

In one embodiment, the second and third openings associated with each bore include axially arranged inlet ports communicating with the bore. Each inlet port communicates with a passage portion having a centerline located in a first plane which is radially spaced from the axis of the bore. In this embodiment, the fourth and fifth openings of the same bore also include axially spaced inlet ports communicating with the bore. Each inlet port communicates with a passage portion having a centerline located in a second plane which, like the first plane, is radially spaced from the axis of the bore and which intersects the first plane at an angle of 90°. Also in this embodiment, the first opening associated with each bore includes an inlet port which communicates with the bore and which has a mid-point which is oppositely radially spaced relative to the axis of the bore from the point of intersection of the first and second planes. This arrangement forms an efficient loop scavenging system for the bore. It also facilitates machining of the various openings after the block has been fabricated.

One of the principal features of the invention is the provision of an internal combustion engine having removably attachable cover members which, together with openings suitably formed in the block, form exhaust and transfer passages associated with each bore.

Another of the principal features of the invention is the provision of an internal combustion engine which, by virtue of its construction, simplifies manufacturing procedures and which allows a symmetrical placement of ports and passageways to form an efficient loop scavaging system for the engine.

Additional features of the invention will be apparent from the following general description, drawings, and appended claims.

DESCRIPTION OF THE DRAWINGS

FIG. 1 is an exploded perspective view, with parts broken away and in section, of an internal combustion engine which embodies various of the features of the invention and showing the cover members associated with the engine removed from the block;

FIG. 2 is a section view taken generally along line 2—2 in FIG. 1 with the cover members associated with the engine attached on the engine block;

FIG. 3 is a section view taken generally along line 3—3 of FIG. 1 with the cover members associated with the engine attached on the engine block;

FIG. 4 is a section view of one of the cover members associated with the engine taken generally along line 4—4 in FIG. 1 with the cover member removed from the engine block;

FIG. 5 is an exploded perspective view of another embodiment of an internal combustion engine which embodies various of the features of the invention and showing the associated cover members removed from the engine block;

Figure 6:
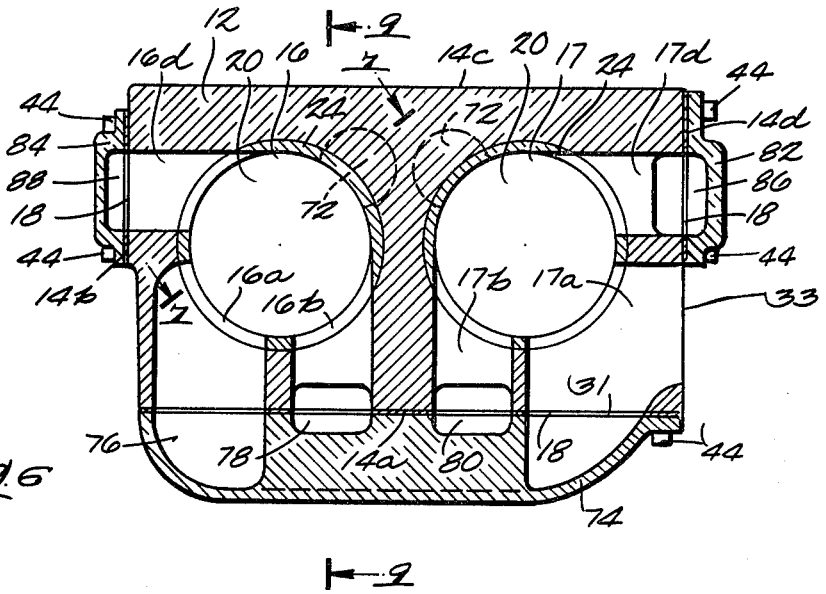
FIG. 6 is a section view taken generally along line 6—6 in FIG. 5 with the cover members associated with the engine attached on the engine block.

Before explaining the embodiments of the invention in detail, it is to be understood that the invention is not limited in its application to the details of the construction and the arrangement of components set forth in the following description or illustrated in the drawings. The invention is capable of other embodiments and of being practiced and carried out in various ways. Also, it is to be understood that the phraseology and terminology being employed herein is for the purpose of description and should not be regarded as limiting.

GENERAL DESCRIPTION

An internal combustion engine 10 is shown in FIG. 1. Although various constructions are possible, in the illustrated embodiment, the engine 10 is a two-stroke cycle crankcase or rear compression engine and includes a generally rectilinear block 12 having four, generally planar, exterior faces 14*a, b, c* and *d*. First and second cylinder bores, respectively 16 and 17, are formed in the block 12. Each bore 16 and 17 includes a combustion chamber portion 20 and a crankcase portion 22. A cylindrical sleeve 24 lines each bore 16 and 17. A piston (not shown) can be mounted in conventional fashion for reciprocative movement in each bore 16 and 17.

The block 12 can be fabricated by the use of a permanent mold or by die casting, with core members employed to form the cylinder bores 16 and 17 during casting. The sleeves 24 may be cast in place in the block 12, or they may be pressed into the bores 16 and 17 after casting.

Five openings communicate with each bore 16 and 17, being preferably machined from outside the block 12 after casting, such as by use of a milling tool having a plunge bore. The openings communicating with the first bore 16 are designated 16*a, b, c, d,* and *e*. The corresponding openings communicating with the second bore 17 are similarly designated 17*a, b, c, d,* and *e*. The sleeve 24 associated with each bore 16 and 17 may include ports which align with the openings when the sleeve 24 is properly positioned in the bore 16 and 17, thereby maintaining the desired communication.

Figure 8:
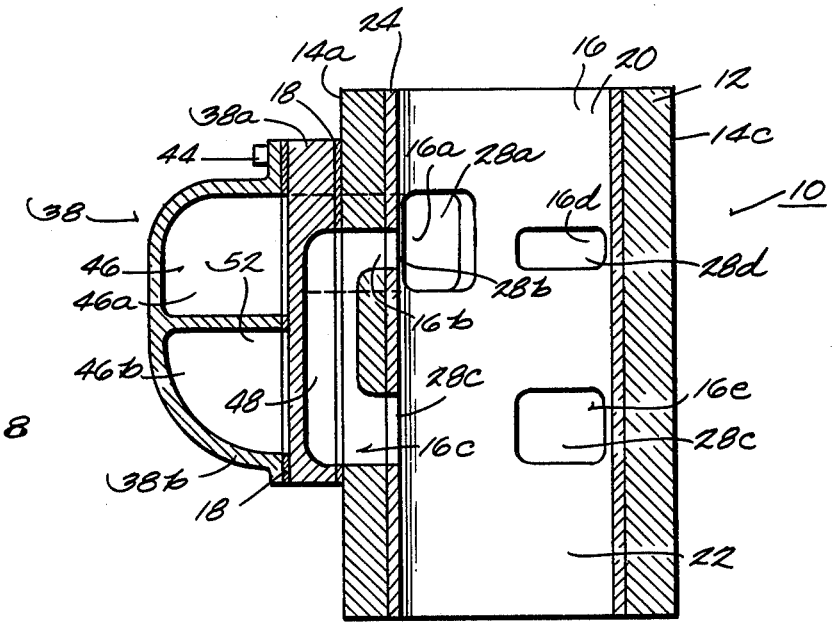
FIG. 8 is a section view taken generally along line 8—8 in FIG. 2.
Figure 9:
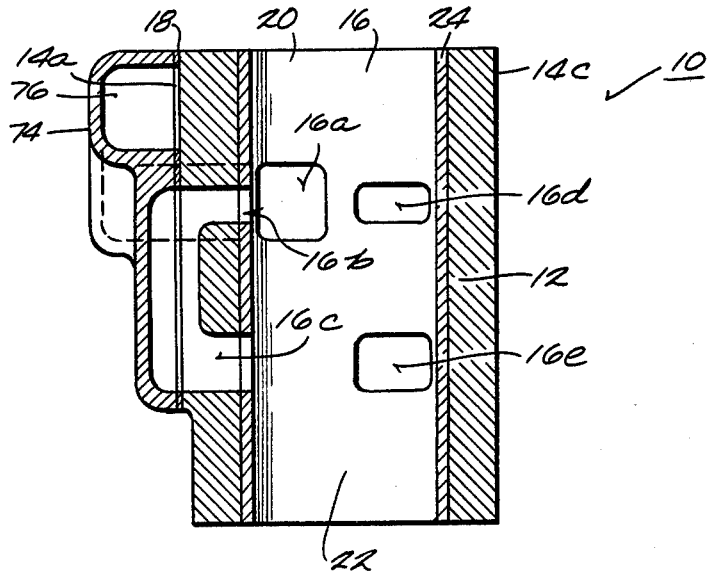
FIG. 9 is a section view taken generally along line 9—9 in FIG. 6.

As can be seen in FIGS. 1, 2 and 8, the first opening 16*a* and 17*a* for each bore 16 and 17 extends through exterior face 14*a* of the block 12 and communicates with the combustion chamber portion 20 of the respective bore 16 and 17. The second and third openings 16*b* and 16*c* (for bore 16) and 17*b* and 17*c* (for bore 17) also extend through exterior face 14*a* of the block 12 and are axially aligned along their respective bores 16 and 17. In particular, each second opening 16*b* and 17*b* (see FIGS. 1, 2 and 8) communicates with the combustion chamber portion 20 of the associated bore 16 and 17, and each third opening 16*c* and 17*c* (see FIGS. 1, 3 and 8) communicates with the crankcase portion 22 of the associated bore 16 and 17.

The fourth and fifth openings 16*d* and 16*e* of the first bore 16 extend in an axially aligned relationship along the bore 16 through exterior face 14*b* of the block 12. The fourth opening 16*d* communicates with the combustion chamber portion 20 of bore 16 (see FIGS. 2 and 8) and the fifth opening 16*e* communicates with the corresponding crankcase portion 22 (see FIGS. 3 and 8).

The fourth and fifth openings 17*d* and 17*e* of the second bore 17 similarly extend in an axially aligned relationship along the bore 17 through the exterior face 14*d* of the block 12 (see FIGS. 1, 2, and 3), and communicate, respectively, with the combustion chamber portion 20 and crankcase portion 22 of the bore 17.

In addition to the heretofore described openings 16*a* through *e* (communicating with bore 16) and 17*a* through *e* (communicating with bore 17), the engine 10 shown in FIG. 1 includes a passage 32 which extends adjacent to the second bore 17 diagonally between the two adjoining exterior faces 14*a* and 14*d* of the block 12. The passage 32 could, alternately, extend in like fashion adjacent to the first bore 16. The passage 32, like the bores 16 and 17, is preferably formed by use of a core member during casting of the block 12.

As is shown in FIGS. 1 through 3, three cover members 38, 40, and 42 are adopted to be removably fitted on the exterior faces 14*a, b* and *d* of the block 12 by means of threaded fasteners 44 or the like. In the illustrated embodiment, a gasket 18 is positioned between each cover member 38, 40, and 42 and the associated block face 14*a, b*, and *d* to affect a sealing interface therebetween. The cover members 38, 40 and 42, like the block 12 itself, may each be fabricated by use of a permanent mold or by die casting.

As can be seen in FIGS. 1 through 4 and 8, the first cover member 38 includes therein three hollowed-out areas forming cavities 46, 48, 50. While various configurations are possible, in the illustrated embodiment, the first cavity 46 is vertically partitioned into a generally U-shaped upper portion 46*a* and a truncated lower portion 46*b* which communicates with the upper portion 46*a* through port 52.

The second and third cavities 48 and 50 of the first cover member 38 extend in in a direction transverse the first cavity 46 and are disposed inwardly of the first cavity 46 and along opposite sides of the midline 47 of the U-shaped cavity portion 46*a* (see FIGS. 2 and 4).

When the cover member 38 is fitted on the block 12, the cavities 46, 48 and 50 communicate in a predetermined manner with the various openings in each bore 16 and 17. More particularly, and as can be seen in FIGS. 2 and 8, when the first cover member 38 is attached on exterior face 14*a* of the block 12, the U-shaped upper portion 46*a* of the first cavity 46 communicates with the first opening 16*a* and 17*a* of each bore 16 and 17. Furthermore, and as can be seen in FIG. 3, when the first cover member 38 is so attached, the lower passage portion 46*b* communicates with the block passage 32 and, thus, with the atmosphere.

In addition, and referring to FIGS. 2, 3 and 8, when the first cover member 38 is attached on exterior face 14*a* of the block 12, the second cavity 48 communicates with the second and third openings 16*b* and 16*c* of the first bore 16, and the third cavity 50 communicates with the the second and third openings 17*b* and *c* of the second bore 17.

By virtue of this arrangement, the partitioned passage portions 46*a* and 46*b* of the first cavity 46, the first openings 16*a* and 17*a*, and the block passage 32 collectively form an exhaust passage for each bore 16 and 17. In addition, the second and third cavities 48 and 50 and the associated second and third openings 16*b* and *c* and 17*b* and *c* form a fuel-air transfer passage for each bore 16 and 17.

While the cover member 38 as just described can be variously constructed, in the illustrated embodiment (see, in particular, FIGS. 1 and 4), a two-piece construction is provided. In this construction, the first cover member 38 includes a first portion 38*a* which includes the second and third cavities 48 and 50 and the adjacently located end sections 58 and 59 of the upper and lower passage portions 46*a* and 46*b*. The first cover member 38 also includes a second portion 38*b* which includes the remaining sections of the first cavity passage portions 46*a* and 46*b*. As shown in FIGS. 2, 3 and 8, the first cover portion 38*a* is fitted on the exterior face 14*a* of the block 12, and the second portion 38*b* is then attached to the exterior face 14*a* on top of the first portion 38*a* to complete the assembly of the cover member 38. A gasket 18 is preferably provided to assure a sealing interface between the two cover member sections 38*a* and 38*b*.

Reference is now made to the second cover member 40, and, in particular, FIGS. 1 through 3. The second cover member 40 includes a cavity 54 which, when the second cover member 40 is removably attached on exterior face 14*d* of the block 12, communicates with each of the fourth and fifth openings 17*d* and 17*e* of the second bore 17. Together, the cavity 54 and the fourth and fifth openings 17*d* and 17*e* form and additional transfer passage associated with the second bore 17.

Furthermore, in order to maintain the desired communication between the first cavity 46 of the first cover member 38 and the atmosphere through passage 32, the second cover member 40 includes a passage 56 which, when the second cover member 40 is attached on exterior face 14*d*, communicates with the block passage 32. It should be realized, however, that, depending upon the desired outer configuration of the engine 10, the second cover member 40 could terminate in a non-interfering relationship with block passage 32, thereby eliminating the need for cover member passage 56.

Reference is now made to the third cover member 42 which includes a cavity 62 (see FIGS. 1 through 3). When the third cover member 42 is attached on the exterior face 14*b* of the block 12, the cavity 62 communicates with each of the fourth and fifth openings 16*d* and 16*e* associated with the first bore 16. The cavity 62, together with the fourth and fifth openings 16*d* and 16*e*, collectively form an additional transfer passage associated with the first bore 16.

While the particular number and angular arrangement of the openings 16*a* through *e* and 17*a* through *e* can vary, in the illustrated embodiment (as best shown in FIGS. 2 and 3), the axially spaced fourth and fifth openings 16*d* and *e* and 17*d* and *e* of each bore 16 and 17 are arcuately spaced from the axially spaced second and third openings 16*b* and *c* and 17*b* and *c* of the same bore 16 and 17 at an angle of approximately 90°.

More particularly, and for the purpose of description, reference is now made only to the arrangement associated with the first bore 16, each of the axially aligned second and third openings 16*b* and *c* includes an inlet port, respectively designated 28*b* and 28*c*. The inlet ports 28*b* and 28*c* communicate with passage portions having axially aligned centerlines which commonly lie in a first plane 64 which extends perpendicularly to the exterior face 14*a* and which is spaced radially outwardly from the axis 66 of the bore 16. The corresponding inlet ports, designated 28*d* and *e*, of the fourth and fifth openings 16*d* and *e* communicate with passage portions having centerlines disposed in a second plane 68 which extends perpendicularly to exterior face 14*b* and which is also spaced radially outwardly of the axis 66 of the bore 16. The first and second planes 64 and 68 intersect each other at a 90° angle along line 70 which extends axially of the axis 66 of the bore 16.

In this construction, and referring now solely to FIG. 2, the first opening 16*a* of the bore 16 includes an inlet port 28*a* which has a center point oppositely radially spaced relative to the bore axis 66 from the line 70 constituting the intersection of the first and second planes 65 and 68 (as shown by phantom line 30 in FIG. 2).

While only the arrangement of the openings associated with the first bore 16 has been described, it should be realized that the openings 17*a* through *e* associated with the bore 17 are preferably arranged identically to those associated with the bore 16.

The above described arrangement facilitates machining of the various openings 16*a* through *e* and 17*a* through *e* after the block 12 has been cast. At the same time, the arrangement serves as an efficient loop scavenging system for each bore 16 and 17.

An alternate embodiment of the engine 10 is shown in FIGS. 5 through 7 and 9. Elements which are common to the just described embodiment (shown in FIGS. 1 through 4 and 8) are assigned common reference numerals.

Like the first embodiment, the block 12 includes four generally planar, exterior faces 14*a, b, c* and *d*. Also like the first embodiment, five openings 16*a* through *e* and 17*a* through *e* are associated with each bore 16 and 17. The openings 16*a* through *e* and 17*a* through *e* are generally arcuately and axially arranged relative to each other as in the first embodiment.

However, unlike the first embodiment, the block 12 shown in FIGS. 5 and 6 does not include the diagonally extending passage 32. Instead, the first opening 17*a* associated with the second bore 17 itself extends generally diagonally between the two adjoining exterior faces 14*a* and 14*b*. In this arrangement, the first opening 17*a* includes a port 31 located in external face 14*a* of the block 12 and a second port 33 located in the adjacent external face 14*d*. Each port 31 and 33 provides communication between the second bore 17 and the atmosphere. It should be realized that, alternately, the diagonal arrangement of the first opening 17*a* of the second bore 17 could be provided for the first opening 16*a* of the first bore 16.

As in the first embodiment, three covers members 74, 82 and 84 are provided which are each removably attachable on the block 12 by means of threaded fasteners 44 or the like. Also as in the first embodiment, when attached on the block 12, the covers 74, 82, and 84, together with the openings 16*a* through *e* and 17*a* through *e*, serve to form transfer and exhaust passages associated with each bore 16 and 17.

More particularly, in the illustrated arrangement, the cover member 74, like cover member 34 of the first embodiment, includes three cavities 76, 78, and 80. The cover member 74 associated with the second embodiment is of unitary construction (see FIG. 5), unlike the two piece construction of the cover member 38 associated with the first embodiment.

As shown in FIGS. 5 and 6, when the cover member 74 is attached on exterior face 14*a* of the block 12, the cavity 76 communicates with the first opening 16*a* of the first bore 16 and the first opening 17*a* of the second bore 17 through port 31. Exhaust from the first and second bores 16 and 17 is thus channelled for common discharge to the atmosphere through port 33.

Figure 7:
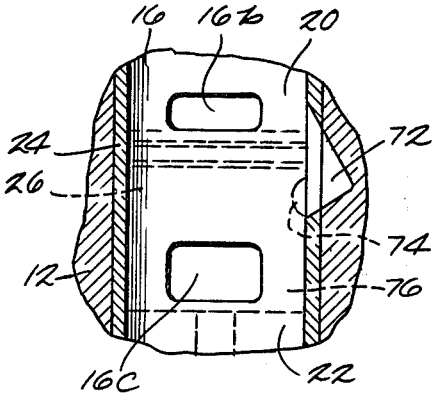
FIG. 7 is a section view taken generally along line 7—7 in FIG. 6.

Furthermore, when the cover member 74 is so attached, the second and third cavities 78 and 80 of cover member 74 communicate, respectively, with the second and third openings 16*b* and *c* and 17*b* and *c* of the bores 16 and 17 to form transfer passages for the bores 16 and 17 (see FIGS. 6 and 7).

Similar to the first embodiment, the second and third cover members 82 and 84 associated with the second embodiment each includes a cavity, respectively 86 and 88. When the cover member 82 is attached on the face 14*d* of the block 12, its cavity 86 communicates with each of the fourth and fifth openings 17*d* and *e* of the second bore 17. Collectively, the openings 17*d* and *c* and the cavity 86 form an additional transfer passage communicating with bore 17.

Similarly, when the cover member 84 is attached on the face 14*b* of the block 12, its cavity 88 communicates with each of the fourth and fifth openings 16*d* and *e* of the first bore 16. Collectively, the openings 16*d* and *e* and the cavity 88 form an additional transfer passage associated with bore 16.

As can be seen in FIGS. 5 and 6, when attached on the block 12, the cover member 82 of the second embodiment terminates in a non-interfering relationship with port 33. However, as heretofore explained with regard to the cover member 40 of the first embodiment, the particular construction of the cover member 82 and the need for a passage comparable to passage 56 in the first embodiment depends principally upon the desired outer configuration of the engine 10.

In the second embodiment, a boost port 72 is formed in each of the bores 16 and 17. These ports 72 may be machined in the block 12 after casting, or formed during casting by use of a disposable core. In this arrangement (as shown in phantom lines in FIG. 7), a corresponding port 74 is formed in the skirt 76 of each piston 26. The piston port 74 registers with the boost port 72 (as shown in FIG. 7) at a predetermined time during piston reciprocation to provide yet another transfer path through which an air-fuel mixture may be delivered into the combustion chamber portion 20 of the engine 10.

While the boost port arrangement is illustrated only in connection with the second embodiment, such a boost port arrangement can be readily incorporated into the first described embodiment shown in FIGS. 1 through 4 and FIG. 8.

Various of the features of the invention are set forth in the following claims.

I claim:

1. An internal combustion engine comprising a cylinder block having a bore, means for forming in said cylinder block first, second, and third openings, each of said openings communicating with said bore, said cylinder block also having means defining an exhaust passage spaced from said bores, and a cover member removably attachable on said cylinder block and including means defining a first cavity communicating with said first opening and with said exhaust passage when said cover member is attached on said cylinder block and means defining a second cavity communicating with each of said second and third openings when said cover member is attached on said cylinder block.

2. An internal combustion engine according to claim 1 wherein said block opening forming means includes means for forming said second and third openings in an axially spaced relationship along said bore.

3. An internal combustion engine comprising a cylinder block having first and second exterior faces extending transversely of each other, a bore, and means for forming in said cylinder block first, second, third, fourth and fifth openings, each of said openings communicating with said bore, said first, second, and third openings opening into said first face and said fourth and fifth openings opening into said second face, said second and third openings being axially spaced along said bore, said fourth and fifth openings being axially spaced along said bore and arcuately spaced from said second and third axially spaced openings, a first cover member removably attachable on said first face of said cylinder block and including means defining a first cavity communicating with said first opening when said cover member is attached on said cylinder block and means defining a second cavity communicating with each of said second and third openings when said cover member is attached on said cylinder block, and a second cover member removably attachable on said second face of said cylinder block and including means defining a cavity communicating with each of said fourth and fifth openings when said second cover member is attached on said block.

4. An internal combustion engine comprising a cylinder block having a bore, and means for forming in said cylinder block first, second, third, fourth and fifth openings respectively defining first, second, third, fourth and fifth passages, each of said passages communicating with said bore at respective first, second, third, fourth, and fifth ports, said second and third ports being axially spaced along said bore, said fourth and fifth ports being axially spaced along said bore and arcuately spaced from said second and third axially spaced ports, said second and third passages including respective second and third portions extending respectively from said second and third ports, one of said second and thid passage portions having a centerline located in a first plane radially spaced from the axis of said bore, said fourth and fifth passages including respective fourth and fifth portions extending respectively from said fourth and fifth ports, one of said fourth and fifth passage portions having a centerline located in a second plane radially spaced from the axis of said bore and intersecting said first plane at generally a 90° angle, a cover member removably attachable on said cylinder block and including means defining a first cavity communicating with said first port when said cover member is attached on said cylinder block and means defining a second cavity communicating with each of said second and third ports when said cover member is attached on said cylinder block, and a second cover member removably attachable on said cylinder block and including means defining a cavity communicating with each of said fourth and fifth ports when said second cover member is attached on said block.

5. An internal combustion engine according to claim 4 wherein said first opening includes an inlet port communicating with said bore and having a centerline oppositely radially spaced relative to the axis of said bore from the point of intersection of said first and second planes.

6. A crankcase compression internal combustion engine comprising a cylinder block having first and second bores extending in parallel spaced relation to each other, means for forming in said cylinder block a first series of first, second, and third openings each communicating with said first bore, said second and third openings being axially spaced relative to each other, and means for forming in said cylinder block a second series of first, second, and third openings each communicating with said second bore, said second and third openings of said second series being axially spaced from each other, and a cover member removably attachable on said cylinder block and including means defining a first cavity communicating with said first openings of said first and second series when said cover member is attached on said cylinder block, means defining a second cavity communicating with each of said second and third openings of said first series when said cover member is attached on said cylinder block, and means defining a third cavity communicating with each of said second and third openings of said second series when said cover member is attached on said cylinder block.

7. An internal combustion engine according to claim 6 wherein said block opening forming means includes means defining a passage extending in said block in spaced relation to one of said bores and having oppositely spaced end ports each communicating with the atmosphere, and wherein, when said cover member is attached on said block, said first cavity of said cover member communicates with said block passage through one of said end ports.

8. An internal combustion engine according to claim 7 wherein said first cavity of said first cover member includes a first passage portion communicating with each of said first openings in said first and second bores and a second passage portion communicating with said first passage portion and said one end port of said block passage when said first cover member is attached on said block.

9. An internal combustion engine according to claim 6 wherein said cover member includes a first body portion removably attachable upon said cylinder block and including said second and third cavities and portions of said first cavity, and a second body portion including the remaining portions of said first cavity and being removably attachable upon said first body portion with said portions of said first cavity in communication with each other.

10. An internal combustion engine according to claim 6 wherein said first opening communicating with one of said first and second bores includes spaced first and second outlet ports each communicating with the atmosphere, and wherein, when said cover member is attached on said cylinder block, said first cavity of said cover member communicates with one of said first and second outlet ports of said first opening of said one bore and with said first opening of the other one of said first and second bores.

* * * * *